US010259218B2

(12) United States Patent
Maher et al.

(10) Patent No.: US 10,259,218 B2
(45) Date of Patent: Apr. 16, 2019

(54) EJECTION DEVICE FOR INKJET PRINTERS

(71) Applicant: FUNAI ELECTRIC CO., LTD., Osaka (JP)

(72) Inventors: Colin Maher, Georgetown, KY (US); Kent Ubellacker, Georgetown, KY (US); Dave Weatherly, Versailles, KY (US)

(73) Assignee: Funai Electric Co., Ltd., Osaka (JP)

( * ) Notice: Subject to any disclaimer, the term of this patent is extended or adjusted under 35 U.S.C. 154(b) by 68 days.

(21) Appl. No.: 14/189,891

(22) Filed: Feb. 25, 2014

(65) Prior Publication Data

US 2015/0239241 A1 Aug. 27, 2015

(51) Int. Cl.
*B41J 2/14* (2006.01)

(52) U.S. Cl.
CPC ..... *B41J 2/14145* (2013.01); *B41J 2/1404* (2013.01); *B41J 2202/11* (2013.01); *B41J 2202/12* (2013.01)

(58) Field of Classification Search
USPC ... 347/40, 44, 47, 48, 62, 63, 65, 68, 85, 89
See application file for complete search history.

(56) References Cited

U.S. PATENT DOCUMENTS 5,818,485 A * 10/1998 Rezanka ..... 347/89
6,409,312 B1 * 6/2002 Mrvos et al. ..... 347/54
8,118,408 B2 * 2/2012 Xie ..... B41J 2/04 347/54
8,540,355 B2 9/2013 Govyadinov et al.
8,827,427 B2 * 9/2014 Yoshida ..... B41J 2/155 347/65
8,915,576 B2 * 12/2014 Uezawa ..... B41J 2/14274 347/47
9,211,721 B2 * 12/2015 Govyadinov ..... B41J 2/175
2007/0081036 A1 * 4/2007 Silverbrook ..... B41J 2/0458 347/56
2010/0208010 A1 * 8/2010 Inoue ..... B41J 2/14145 347/85
2012/0113197 A1 5/2012 Kashu et al.
2012/0293584 A1 * 11/2012 Fang et al. ..... 347/44
2012/0320130 A1 * 12/2012 Anderson et al. ..... 347/47
2013/0027477 A1 * 1/2013 Guan et al. ..... 347/71
2013/0083136 A1 4/2013 Govyadinov et al.

* cited by examiner

*Primary Examiner* — Alejandro Valencia
(74) *Attorney, Agent, or Firm* — Amster, Rothstein & Ebenstein LLP

(57) ABSTRACT

A fluid ejection including a substrate having at least one fluid ejecting element adapted to eject a fluid, a flow feature layer disposed over the substrate, the flow feature layer including a plurality of flow features, a nozzle plate layer disposed over the flow feature layer, the nozzle plate layer including one or more nozzle arrays, each nozzle in each of the one or more nozzle arrays being in fluid communication with a corresponding flow feature of the plurality of flow features and a corresponding fluid ejecting element of the at least one fluid ejecting elements, at least one intake via through which fluid flows into the plurality of flow features, and at least one output via through which fluid flows out of the plurality of flow features.

4 Claims, 7 Drawing Sheets

EJECTION DEVICE FOR INKJET PRINTERS

FIELD

The present invention related generally to inkjet printers, and more particularly, to ejection devices for inkjet printers.

BACKGROUND

Thermal inkjet printheads have two major issues that are generally lumped in the category called printhead maintenance. The two issues are coined "startup" and "idle time." When a printer is not in use for any time period from a few minutes to a few weeks, the printhead is generally capped to prevent excessive drying of ink in the nozzles which are exposed to the air. Evaporation of water from the ink in the nozzles causes the viscosity to increase significantly. Still, no cap can provide a perfect seal, and drying occurs either due to leakage in the seal, or diffusion through the capping materials. For typical extended capping periods in the range of a weekend, the drying can be excessive enough to require large amounts of waste "spits" before starting up the first printing job. Even worse, at times a pump must be employed to pull ink through the nozzles to eliminate the dried ink. This is the essence of the "startup" problem. To get a nozzle with dried ink to startup, a certain amount of ink must be wasted prior to the nozzles first print on the page. In addition to the wasted ink, these startup algorithms are often noisy, and can take significant time—sometimes several minutes—which is undesirable to the customer, because it increases the time to first print.

While printing, and depending on the images being printed, many nozzles may not be called upon to produce a dot. In this case, idle nozzles aren't capped, but rather they are in open air and they experience forced convection due to the movement of the printhead carrier. If a nozzle hasn't been used for as little as a few seconds during a print job, then the ink in the nozzle can dry, and the viscosity can increase enough to compromise the quality of the next few ejected drops from that nozzle. To avoid noticeable print quality issues due to idle time, typically the printhead returns to the maintenance station to spit all nozzles at a required interval. Again, this wastes ink, passing undesirable added cost to the customer. Since nozzles that are uncapped and on a moving printhead become unacceptably dry in a matter of a few seconds, idle time spits can have a significant, adverse effect on print speed.

Waste ink generated by idle time and startup spits increases linearly with the number of nozzles present in the inkjet printhead. Thus, as heater chips continue to grow in length to increase print speed the waste ink amount grows to uneconomical volumes, in some cases equaling or even exceeding the amount of usable ink in the system. In the case of a page-wide printhead, it is extremely so. Also, for specialty inks with higher solid content in the commercial/industrial printing markets, such as a latex ink or ink with binder, this problem gets increasingly worse. In applications where maintenance stations do not exist, such as in many industrial printing applications, there is also a need for the printhead to startup without any maintenance spits.

Other solutions to these two problems involve re-circulating ink upstream of the ejector, or often even upstream of the filter. However, to truly keep nozzles fresh and ready to fire, recirculation must happen at the ejector level. Another conventional solution is to recycle ink that has been primed through the nozzles for the purpose of enabling a quality startup. Although this technique avoids wasting ink, in a multi-color printer it requires a separate seal for each color thereby rendering the technique nearly impossible to use with a multi-color heater chip. Also, this technique can be used to reclaim ink from mid-print job spits for idle time, but it is not helpful for increasing the time interval required between spits. Thus, the print speed reduction due to idle time spits is not reduced.

Other conventional art includes United States Patent Application US2012/07921A1. Here, an extra heater positioned at the end of the heater array is used to pump ink from the via, along the array, through the ejectors and back into the via. This embodiment has a significant drawback in that a pressure drop occurs across each ejector resulting in minimal flow rate toward the center of an array of ejectors.

A solution is needed for the startup and idle time problems that doesn't waste ink, works for a multi-color heater chip, and does not slow down print speed.

SUMMARY OF THE INVENTION

A fluid ejection device according to an exemplary embodiment of the present invention comprises: a substrate comprising at least one fluid ejecting element adapted to eject a fluid; a flow feature layer disposed over the substrate, the flow feature layer comprising a plurality of flow features; a nozzle plate layer disposed over the flow feature layer, the nozzle plate layer comprising one or more nozzle arrays, each nozzle in each of the one or more nozzle arrays being in fluid communication with a corresponding flow feature of the plurality of flow features and a corresponding fluid ejecting element of the at least one fluid ejecting elements; at least one intake via through which fluid flows into the plurality of flow features; and at least one output via through which fluid flows out of the plurality of flow features.

According to at least one embodiment, the one or more nozzle arrays comprise a plurality of nozzle arrays.

According to at least one embodiment, the plurality of nozzle arrays are in fluid communication with one another so as to form a plurality of fluid flow paths, each fluid flow path extending from the at least one intake via, across at least one nozzle of each of the plurality of nozzle arrays, and to the at least one output via.

According to at least one embodiment, the plurality of fluid flow paths are in fluid communication with one another between the plurality of nozzle arrays.

According to at least one embodiment, the plurality of fluid flow paths are not in fluid communication with one another between the plurality of nozzle arrays.

According to at least one embodiment, the nozzle plate layer further comprises an array of priming orifices.

According to at least one embodiment, the substrate is made of silicon.

According to at least one embodiment, the at least one fluid ejecting element is a resistor element.

According to at least one embodiment, the at least one fluid ejecting element is a piezoelectric element.

Other features and advantages of embodiments of the invention will become readily apparent from the following detailed description, the accompanying drawings and the appended claims.

BRIEF DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION

Figure 1:
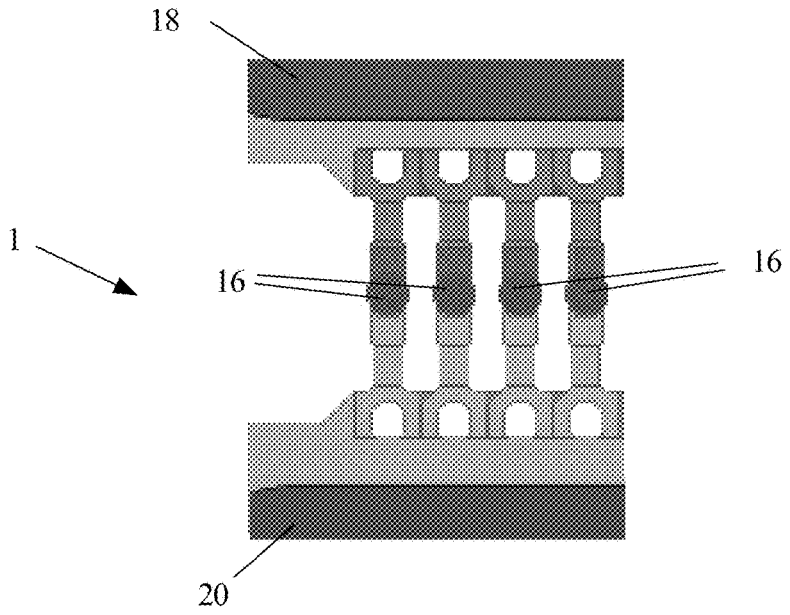
FIG. 1 is a plan view of an inkjet printhead according to an exemplary embodiment of the invention.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

Figure 2:
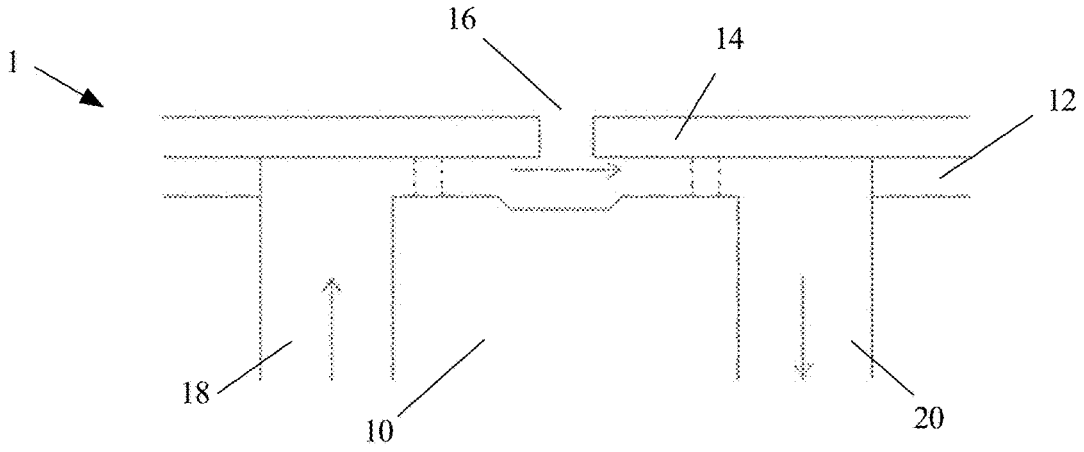
FIG. 2 is a cross-sectional view of an inkjet printhead according to an exemplary embodiment of the invention.

An inkjet printhead according to an exemplary embodiment of the present invention includes a flow-through ejector, multiple vias per color and a pump to re-circulate the ink. A flow-through ejector is an ejector that allows ink to flow through it. For example, FIG. 1 is a plan view and FIG. 2 is a partial cross-sectional view of an inkjet printhead, generally designated by reference number 1. The inkjet printhead 1 includes a substrate 10 including actuators, flow-feature layer 12, a nozzle plate layer 14, an array of nozzles 16, an input-side ink via 18 and a output-side ink via 20. As is known in the art, the substrate may be made of silicon, and the actuators may be resistors or piezoelectric elements. A pump (not shown) is used upstream in the fluidic path, to generate flow of bulk ink to the input-side ink via 18, across the nozzles 16, and exiting through the output-side ink via 20, as shown in FIG. 2. This arrangement preserves the bulk water concentration of the ink all the way up to the bottom of the nozzles 16. Of course, water can still evaporate from the nozzles 16, causing drying and increased viscosity. However, the viscosity increase can not advance past the flow of ink in the flow feature layer 12.

In another implementation of the present embodiment, the pump is turned off, and an increased viscosity front advances past the bottom of the nozzles 16 and into the flow feature layer 12 and perhaps beyond. The pump can then be turned on in regular intervals to clear the high viscosity ink, mixing it into the bulk ink supply. Depending on many factors, such as ink composition and environmental conditions, the pump can be ran periodically, such as hourly, daily, or only immediately prior to printing, or in extreme cases, continuously. The duration of each pump run may depend on the same factors used to determine periodicity. This eliminates, or significantly reduces the need to spit and/or prime nozzles after long periods of disuse. Since the fluid never leaves the printhead, no ink is wasted.

For the idle time problem, the pump may be ran while printing, maintaining fresh ink in all nozzles, even if some nozzles are not used. This eliminates the need to stop printing, return to the maintenance station and spit waste ink. While printing, it is estimated that the high viscosity front can move through the bottom of the nozzle at a velocity of about 10 μm/s. Thus, the fluid velocity may be at least 10 μm/s to adequately keep nozzles fresh. This estimate assumes standard environmental conditions and a typical commercialized aqueous based pigment ink.

Since the flow advances through all ejectors in parallel, the present invention solves the pressure drop problem associated with the structure disclosed in application US2012/0007921A1.

In various exemplary embodiments of the present invention, two ink vias may be needed for each ink color integrated into the chip. For example, for a one color chip, two vias would be needed, and for a three color chip, six vias would be needed. However, during high coverage printing, when flow rate demands are high, the pump may be turned off, allowing both vias to supply the ejector. In a high coverage print, all nozzles are usually needed and idle time is rarely an issue, so the pump would likely not need to run during printing. Therefore, the vias could be smaller than the typical one via per array design and still provide the necessary flow rate without a significant pressure drop across the via. Firmware algorithms may be used to determine high coverage printing situations where the pump would not be needed.

Figure 3:
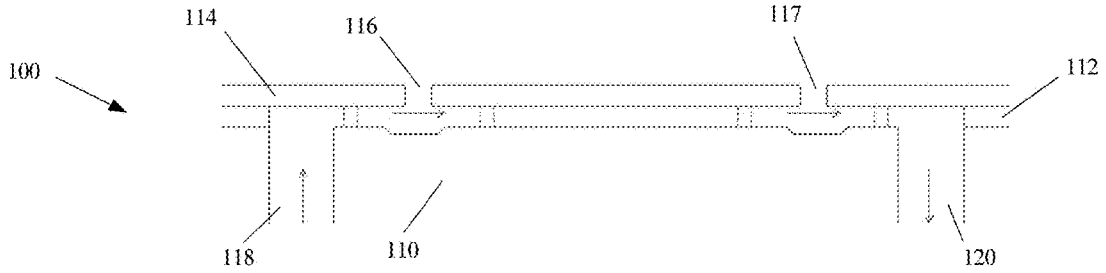
FIG. 3 is a cross-sectional view of an inkjet printhead according to another exemplary embodiment of the invention.

FIG. 3 is a cross-sectional view of an inkjet printhead, generally designated by reference number 100, according to another exemplary embodiment of the present invention. This embodiment differs from the previous embodiment in that more than one array of ejectors may correspond to each via, thereby increasing ejector density and better utilizing valuable silicon space. The inkjet printhead 100 includes a substrate 110 including actuators, flow-feature layer 112, a nozzle plate layer 114, a first array of nozzles 116, a second array of nozzles 117, an input-side ink via 118 and a output-side ink via 120. As shown by the arrows, ink flows by action of a pump (not shown) from input-side ink via 118, through flow features in flow feature layer 112, across and through active nozzles in the nozzle arrays 116, 117, and to output-side ink via 120.

Figure 4A:
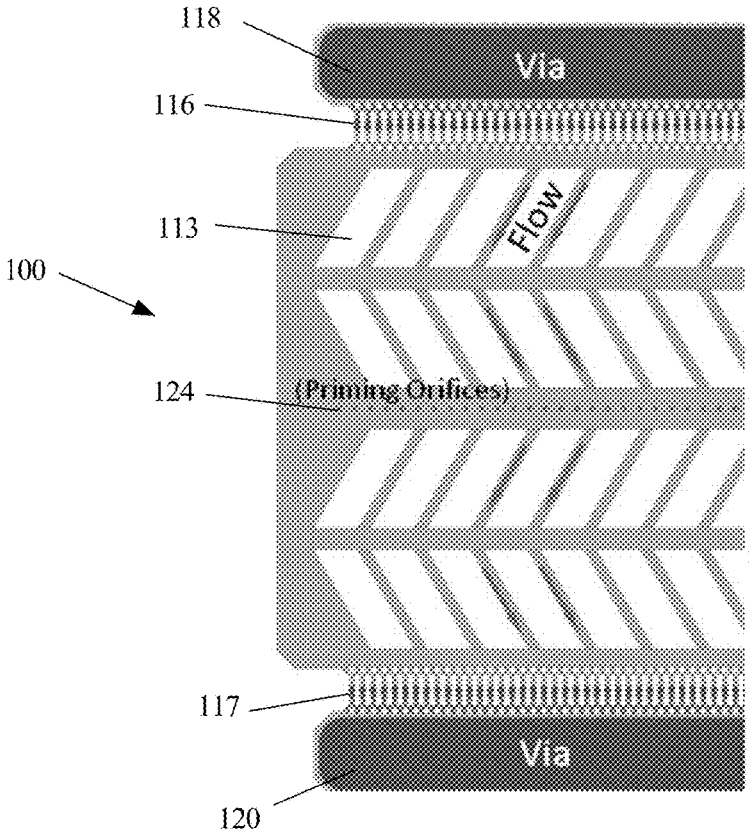
FIG. 4A is a plan view of an inkjet printhead according to an exemplary embodiment of the invention.
Figure 4B:
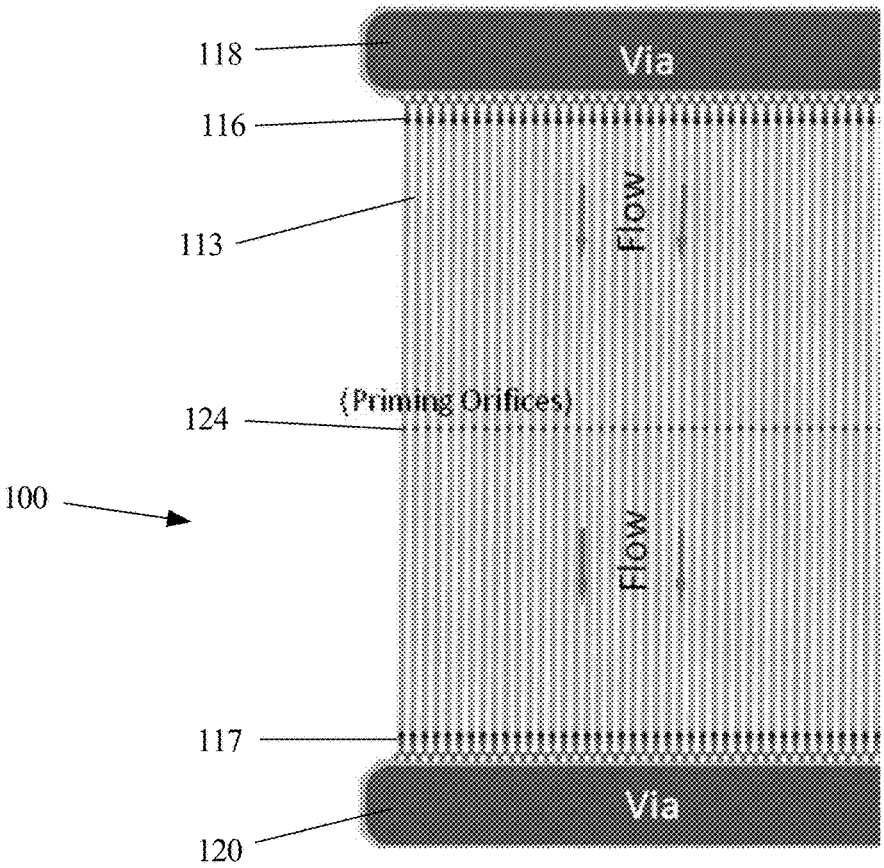
FIG. 4B is a plan view of an inkjet printhead according to an exemplary embodiment of the invention.

There are many different possible ways to provide fluid communication from via to via and across the ejectors. FIGS. 4A and 4B are plan views showing two possible designs of an inkjet printhead according to exemplary embodiments of the present invention in which more than one nozzle array corresponds to each via. In both layouts, flow feature layer material 113 may be left between vias 118, 120 to prevent the nozzle plate layer 114 from touching the heater chip (substrate 110). Depending on the manufacturing process method used to make these structures, these spacer features may or may not be needed. As shown in FIG. 4B, nozzles 116, 117 may be kept substantially isolated from each other fluidically, to avoid crosstalk. Priming orifices 124 may be provided to more easily evacuate air during the initial prime of the printhead 100. It may be advantageous to add additional ejectors on the outboard side of each via, as opposed to only between vias, as shown. For example, FIG.

7 shows an embodiment including two vias, two arrays of flow-thru ejectors between the two vias, and two additional arrays of ejectors outboard of each of the two vias.

Figure 5:
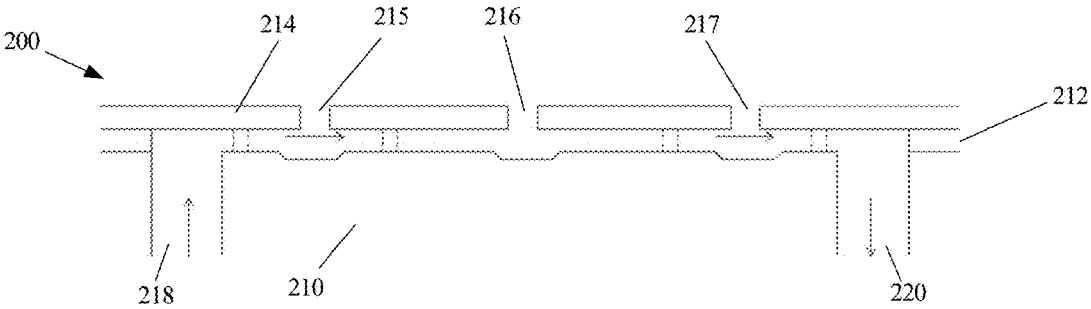
FIG. 5 is a cross-sectional view of an inkjet printhead according to another exemplary embodiment of the invention.

Depending on the electrical and fluidic constraints of the device, an inkjet printhead according to another exemplary embodiment of the present invention may include one or more ejector arrays between the two arrays adjacent to the vias. For example, FIG. 5 shows an inkjet printhead 200 including a substrate 210 including actuators, flow-feature layer 212, a nozzle plate layer 214, a first array of nozzles 215, a second array of nozzles 216, a third array of nozzles 217, an input-side ink via 218 and a output-side ink via 220. As shown by the arrows in FIG. 5, ink flows by action of a pump (not shown) from input-side ink via 218, through flow features in flow feature layer 212, across and through active nozzles in the nozzle arrays 215, 216, 217, and to output-side ink via 220.

Figure 6A:
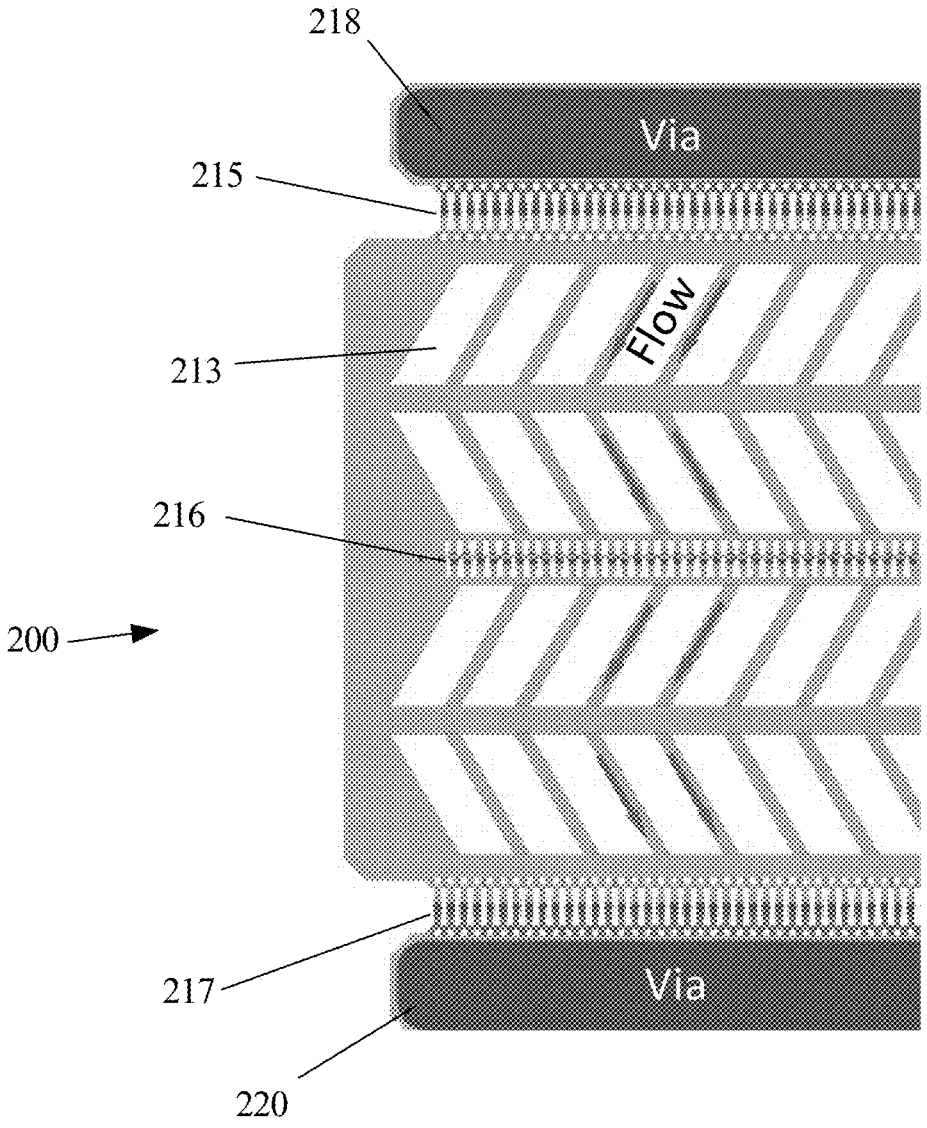
FIG. 6A is a plan view of an inkjet printhead according to an exemplary embodiment of the invention.
Figure 6B:
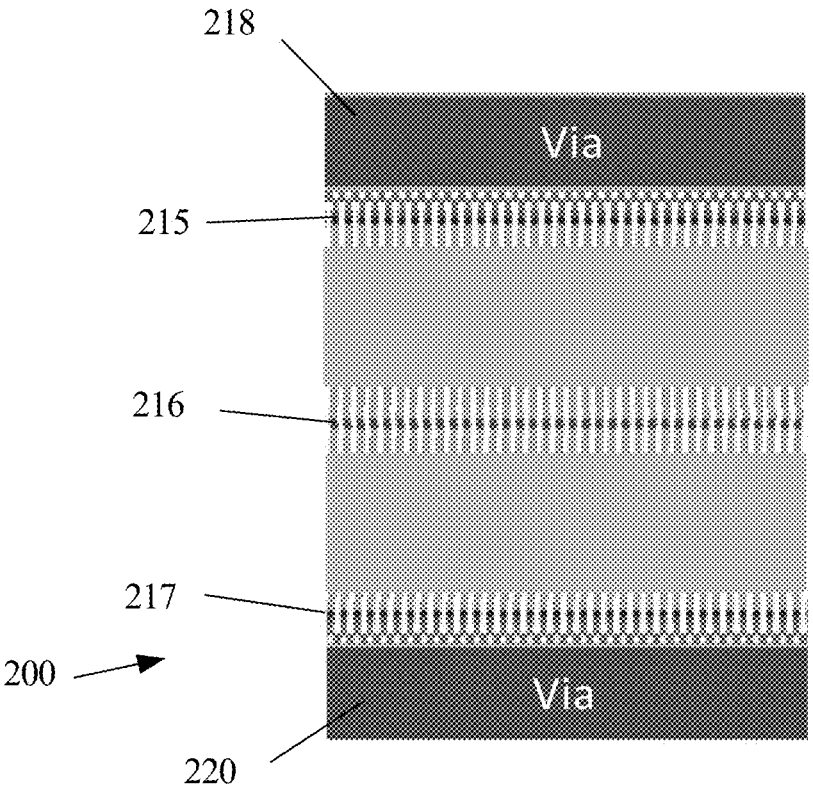
FIG. 6B is a plan view of an inkjet printhead according to an exemplary embodiment of the invention.

FIGS. 6A and 6B show two possible layouts of the inkjet printhead according to an exemplary embodiment of the present invention in which three nozzle arrays are arranged between each via with flow feature layer material 213 left between vias 218, 220. The arrangement shown in FIG. 6A is similar to that shown in FIG. 4A in that ink flow is combined between nozzle arrays. The arrangement shown in FIG. 6B is similar to that shown in FIG. 6A except for the absence of "spacers" to ensure the nozzle layer does not sag down and touch the substrate. In both embodiments shown in FIGS. 6A and 6B, priming orifices 224 may be provided to evacuate air during the initial prime of the printhead 200.

According to another exemplary embodiment of the present invention, an inkjet printhead is provided having an edge-feed design, where ink is fed from the sides of the chip to ejectors that are also located along the sides. Flow-through ejectors are employed to provide a recirculation path from one side of the chip to the other.

An issue surrounding this invention is the quality of the ejected droplets. The ejectors are placed in a channel instead of the conventional approach of having a bubble chamber walled on three sides. A concern is that the energy imparted by the bubble onto the ink will be less directed toward the nozzle, and more directed in both the positive and negative axial directions of the channel. In this regard, the effect has been measured, and the resulting droplet quality is quite acceptable. A conventional ejector delivers 2.9 ng, 490 in/s droplets with a given ink and optimized electrical pulse input. With identical ink, and electrical input; with identical physical geometry, except the back of the chamber is opened to a filter pillar, then to an open area between vias as in the embodiment shown in FIG. 6A, the flow-through ejector delivers 2.4 ng, 400 in/s droplets. The peak frequency of the flow-through ejectors was increased from 28 kHz to about 36 kHz. These parameters, though different, are generally either acceptable, as in the case of the velocity, or can be adjusted with minor design changes, as in the case of the drop mass and peak frequency.

In order to illustrate various advantages of the present invention, the following experiments were performed:

Accelerated Startup: The printhead is left uncapped and in normal carrier motion for 33 minutes. By putting the printhead in motion, and leaving the printhead uncapped, the drying mechanism for startup is accelerated.

Idle Time Test: Idle time is measured by idling the printhead while uncapped, and swathing for zero to five seconds, in one second increments. Drops are printed before and after idling, and the resulting misdirection is measured as a function of the time idled. When the misdirection exceeds 84 μm, this is determined to be the minimum acceptable idle time.

EXAMPLE 1

Figure 7:
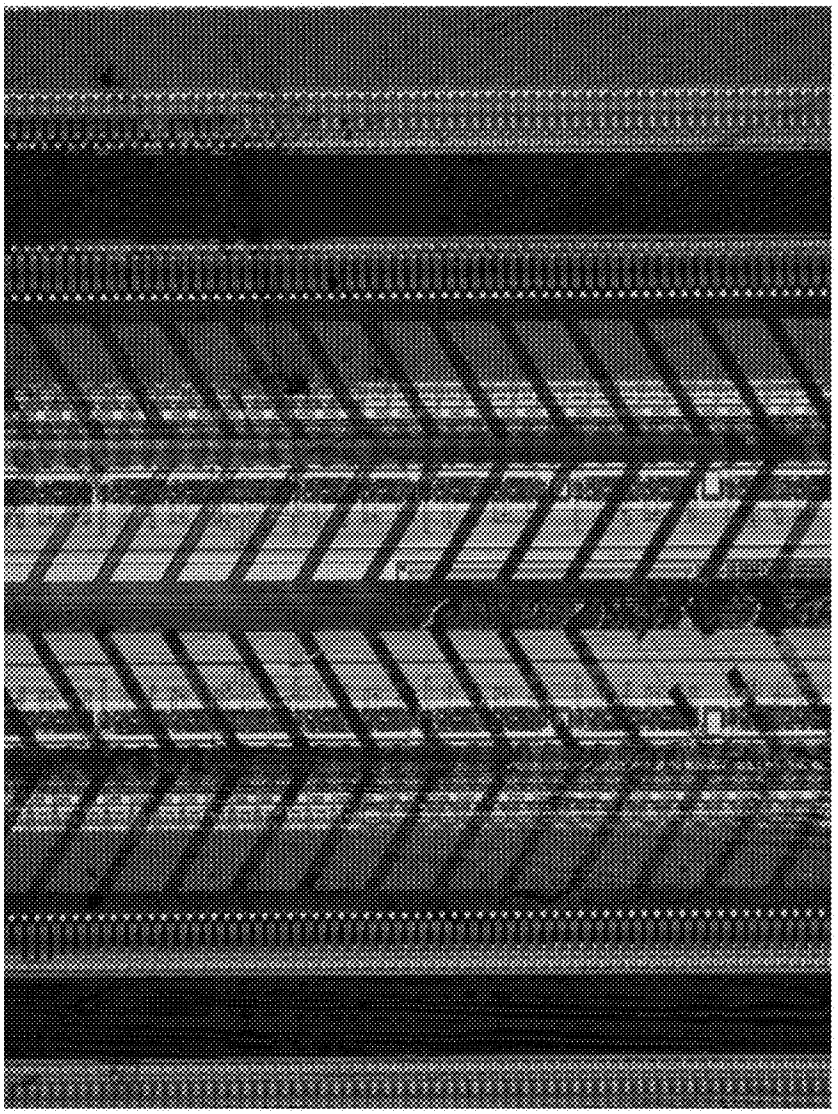
FIG. 7 is a photograph of an exemplary inkjet printhead according to an exemplary embodiment of the invention.
Figure 8:
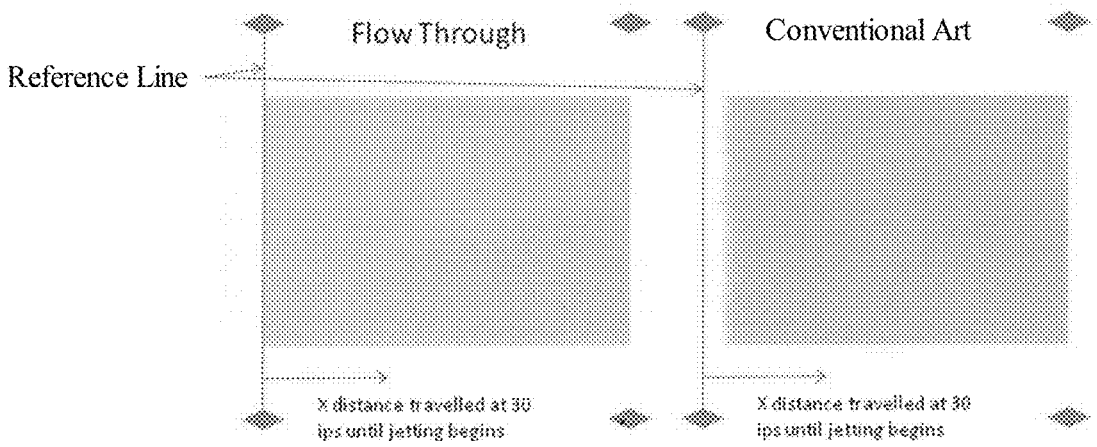
FIG. 8 is a graph showing a comparison of test patterns generated by an inkjet printhead according to an exemplary embodiment of the present invention and a conventional inkjet printhead.

An inkjet printhead having a layout similar to that shown in FIG. 6A is provided. The inkjet printhead includes four ejector arrays per two vias, per one color. A pressure drop of 47 cmwc from via to via produced a fluid velocity of about 5 mm/s within each flow channel. A photograph of the experimental test vehicle is shown in FIG. 7. Accelerated Startup was then measured for this printhead. With a conventional ejector, it takes an average of 26 fires to begin jetting and 59 fires to jet in a high quality manner. With the provided flow-through ejectors, it took zero fires to begin jetting and nine fires to jet in a high quality manner. FIG. 8 shows a comparison of the two test patterns.

An idle time test was also run with the same test vehicles. The idle time for conventional ejectors at ambient environmental conditions ranged from 2.5 to 2.9 seconds, as expected. The misdirection due to idle time up to five seconds for the flow-through ejectors never exceeded 84 μm.

* * *

While particular embodiments of the invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A fluid ejection device comprising:

a substrate having mounted thereon a first array of fluid ejecting elements and a second array of fluid ejecting elements;

a flow feature layer disposed over the substrate, the flow feature layer comprising a plurality of flow features, the plurality of flow features comprising:

first flow features that form first fluid flow channels, the first array of fluid ejecting elements being positioned within the first fluid flow channels;

second flow features that form second fluid flow channels, the second array of fluid ejecting elements being positioned within the second fluid flow channels; and third flow features that form third fluid flow channels, the first, second and third fluid flow channels being arranged on a common plane with the third fluid flow channels disposed between the first and second fluid flow channels;

a nozzle plate layer disposed over the flow feature layer, the nozzle plate layer comprising a first nozzle array and a second nozzle array, the first nozzle array being in fluid communication with the first fluid flow channels, and the second nozzle array being in fluid communication with the second fluid flow channels;

an intake via through which fluid flows directly into the first fluid flow channels; and an output via through which fluid flows directly out of the second fluid flow channels, wherein the first fluid flow channels, the second fluid flow channels, the third fluid flow channels, the intake via and the output via are in fluid communication with one another through the flow feature layer so as to form a plurality of fluid flow paths, each fluid flow path extending across at least one nozzle of each of the first and second nozzle arrays, wherein each respective nozzle in the first nozzle array is aligned with a corresponding one of the plurality of nozzles in the second nozzle array along respective axes, wherein the nozzle plate layer further comprises an array of priming orifices each disposed along a corresponding one of the respective axes between, and equidistant from, the first and second nozzle arrays, and wherein the plurality of fluid flow paths are not in fluid communication with one another between the first and second nozzle arrays.

2. The fluid ejection device of claim 1, wherein the substrate is made of silicon.

3. The fluid ejection device of claim 1, wherein at least one fluid ejecting element of the first array of fluid ejecting elements and the second array of fluid ejecting elements is a resistor element.

4. The fluid ejection device of claim 1, wherein at least one fluid ejecting element of the first array of fluid ejecting elements and the second array of fluid ejecting elements is a piezoelectric element.

* * * * *